US005674359A

United States Patent [19]

Chasse et al.

[11] Patent Number: 5,674,359

[45] Date of Patent: Oct. 7, 1997

[54] CONTINUOUS COOKING OF CELLULOSIC FIBROUS MATERIAL WITH COLD ALKALI IMPREGNATION

[75] Inventors: R. Fred Chasse, Lake George; Bruno S. Marcoccia, South Glen Falls, both of N.Y.; Kaj O. Henricson, Kotka, Finland

[73] Assignee: Ahlstrom Machinery Inc., Glen Falls, N.Y.

[21] Appl. No.: 384,540

[22] Filed: Feb. 8, 1995

[51] Int. Cl.[6] ..... D21C 3/26

[52] U.S. Cl. ..... 162/19; 162/41; 162/43; 162/62; 162/237

[58] Field of Search ..... 162/19, 41, 43, 162/62, 82, 237

[56] References Cited

U.S. PATENT DOCUMENTS

| | | | |
|---|---|---|---|
| 3,654,070 | 4/1972 | Pradt et al. | 162/30 |
| 3,802,956 | 4/1974 | Backlund | 162/19 |
| 5,080,755 | 1/1992 | Backlund | 162/19 |
| 5,522,958 | 6/1996 | Li | 162/19 |

OTHER PUBLICATIONS

Clayton, D. W. "Multi-stage polysulfide pulping processes", Pulp & Paper Magazine Canada, pp. T619–T630 Dec. 1967.

Norden S. "Modified kraft. . pulp", TAPPI, vol. 62. No. 7, pp. 49–51. Jul. 1979.

Disa Tormund, "New Findings on Sulfide . . . Liquors", May 1989, TAPPI Journal, pp. 205–210.

*Primary Examiner*—Donald E. Czaja
*Assistant Examiner*—Dean T. Nguyen
*Attorney, Agent, or Firm*—Nixon & Vanderhye, P.C.

[57] ABSTRACT

The pretreatment of cellulosic fibrous material is adjusted to improve pulp strength. The cellulosic material is initially pretreated with a low temperature alkaline liquid (e.g. 80°–110° C.), and then with a higher temperature (but still below cooking temperature), higher alkali concentration liquor. Only then is the material—which has alkali which has completely penetrated the cellulose fiber walls—subjected to cooking with white liquor at a temperature of about 150°–180° C. Green, white, or black liquor can be used in the first impregnation zone, while white liquor (with polysulfide addition) is preferably used in the second zone.

24 Claims, 2 Drawing Sheets

CONTINUOUS COOKING OF CELLULOSIC FIBROUS MATERIAL WITH COLD ALKALI IMPREGNATION

BACKGROUND AND SUMMARY OF THE INVENTION

White liquor impregnation is necessary in order to properly prepare the cellulosic fibrous material for cooking during the production of kraft pulp. Whether the impregnation is practiced in a separate impregnation vessel, or in an impregnation zone of a digester (e.g. in a one vessel vapor or hydraulic system), the temperature is typically kept at about 105°–120° C. at a pressure of about 15–25 bar for about 15–20 minutes. The cellulosic material is passed to the cooking zone in the digester, or from a separate impregnation vessel to the digester, and actual cooking then takes place at a temperature of about 150°–180° C. It has always been assumed that during impregnation the wood is penetrated with cooking liquor, but for unknown reasons there has been a strength loss which varies with species, but is found to be larger for wood species that have thicker fiber walls.

According to the present invention it has been determined that strength losses can be avoided by first ensuring that the wood, or other cellulose, is penetrated with a relatively cold alkali at the beginning of the impregnation. By penetrating the wood with relatively cold alkali initially, it can be ensured that the wood is not heated without alkali in the interior of the fibers. If wood fiber is heated in neutral or acid conditions (such as if alkali does not adequately penetrate the fiber walls) then the wood fibers will be damaged.

In addition to providing an initial pretreatment that is relatively "cold", according to the present invention the alkali that is utilized contains relatively high amounts of sulfur, which is provided by white liquor or green liquor, or even black liquor, and sometimes even with polysulfide addition. The sulfur is absorbed on the wood during the pretreatment process and thus is present during cooking. Sulfur makes delignification more selective and facilitates the speed of delignification, resulting in a better pulp strength.

According to one aspect of the present invention a method of continuously cooking cellulosic fibrous material is provided comprising the steps of substantially continuously: (a) Treating cellulosic fibrous material with at least one of white liquor, black liquor, and green liquor in a first zone at a temperature of between about 80°–110° C. (preferably 90°–105° C., most preferably 90°–100° C.) and at a first alkali concentration to diffuse alkali into the fiberwalls of the cellulosic fibrous material to open up the cellulose structure and dissolve part of the cellulose. (b) Treating the material from step (a) in a second zone with white liquor and at a temperature at least about 10° C. higher than the first zone and between about 110°–150° C. (preferably 120°–130° C.), and preferably at a second alkali concentration higher than the first alkali concentration, to continue to open up the fiberwalls of the cellulosic fibrous material and dissolve part of the cellulose, to effect complete impregnation of the cellulose fiberwalls with alkali. And, (c) cooking the cellulosic fibrous material from step (b) (with white liquor) at a temperature of about 150°–180° C.

Step (a) is typically practiced for about 5–45 minutes, preferably about 10–30 minutes, and step (b) is also practiced for about 5–45 minutes, preferably about 10–30 minutes. There is the further step, between steps (a) and (b), of removing at least part of the liquid from the cellulosic fibrous material and replacing it with liquid from step (b), and of removing at least a part of the liquid from the cellulosic fibrous material between steps (b) and (c) and replacing it with liquid from step (c). Steps (a) and (b) are typically practiced in substantially consecutive zones in an impregnation vessel, or at the top of a digester, and step (c) is practiced in a continuous digester.

Step (a) is preferably practiced with a first alkali concentration of about 5–30 gr NaOH/l, with step (b) practiced with a second alkali concentration (typically at least 5 gr greater than the first) of about 10–80 gr NaOH/l, preferably about 20–40. Polysulfide may be added to at least one of the first and second zones to increase the hydrosulfide ion to hydroxyl ion ratio ($HS^-/OH^-$).

According to another aspect of the present invention a method of continuously cooking cellulosic fibrous material, utilizing distinct impregnation zones, comprises the following steps: (a) Treating cellulosic fibrous material with at least one of white liquor, black liquor and green liquor in a first impregnation zone at a temperature of between about 80°–110° C. (e.g. at a first alkali concentration of about 5–30 gr NaOH/l) for about 5–45 minutes. (b) Removing liquid from or at the end of the first impregnation zone. (c) Treating the material from step (a) in a second impregnation zone with white liquor and at a temperature (preferably at least about 10° C. higher than the first zone) between about 110°–140° C. (and preferably at a second alkali concentration higher than the first alkali concentration and of about 10–80 gr NaOH/l) for about 5–45 minutes. And, (d) cooking the cellulosic fibrous material from step (c) at a temperature of about 150°–180° C. Liquid also may be removed between steps (c) and (d), in a step (e). Liquid from one of steps (b) and (e) can be removed from the impregnation/cooking system, and/or recirculated from one of steps (b) and (e) to one of steps (a) and (c).

It is the primary object of the present invention to provide more effective pretreatment of cellulosic fibrous material, such as wood chips, during the production of kraft, sulfite or soda pulp, so as to maximize the strength of a pulp produced therefrom. This and other objects of the invention will become clear from an inspection of the detailed description of the invention and from the appended claims.

DETAILED DESCRIPTION OF THE DRAWINGS

Figure 1:
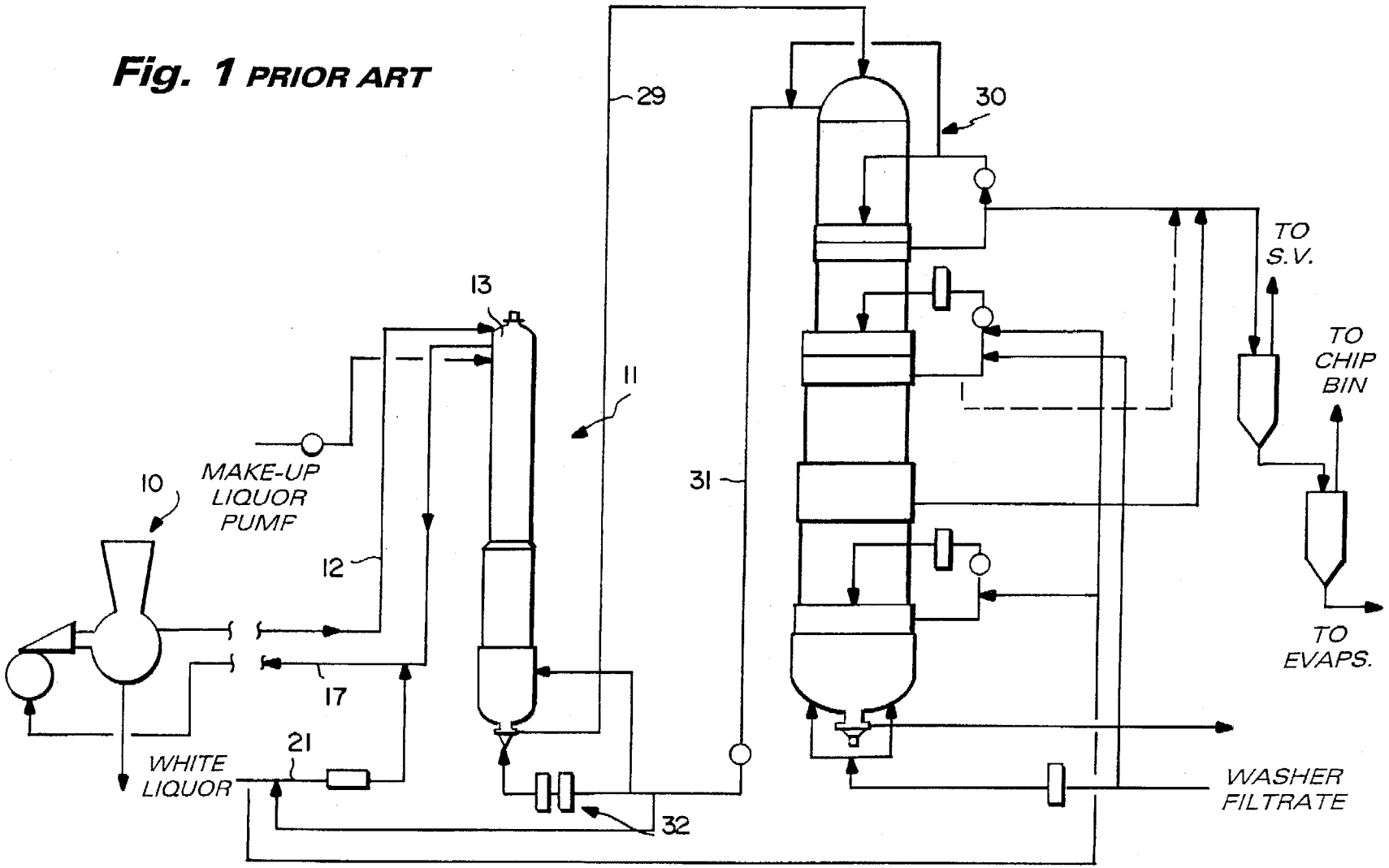
Fig. 1 PRIOR ART
FIG. 1 is a schematic representation of the prior art two vessel hydraulic digester system with standard impregnation.

FIG. 1 illustrates a conventional two vessel hydraulic system with standard impregnation and "Lo-Solids"™ cooking. The system includes a high pressure feeder 10 which feeds an impregnation vessel 11, a high pressure inlet line 12 leading to the top 13 of the impregnation vessel 11, and a return line 17 passing from behind screens at the top of the impregnation vessel 11 to the high pressure feeder 10. White liquor is added to the line 17 to effect impregnation, as well as to various recirculation lines and systems associated with the "Lo-Solids"™ digester 30, available from Kamyr, Inc. of Glens Falls, N.Y. The slurry, cellulose material and white liquor, is fed via line 29 to the top of the digester 30, and from in back of the screens at the top of the digester 30 liquid is removed in line 31, being heated by heaters 32.

Figure 2:
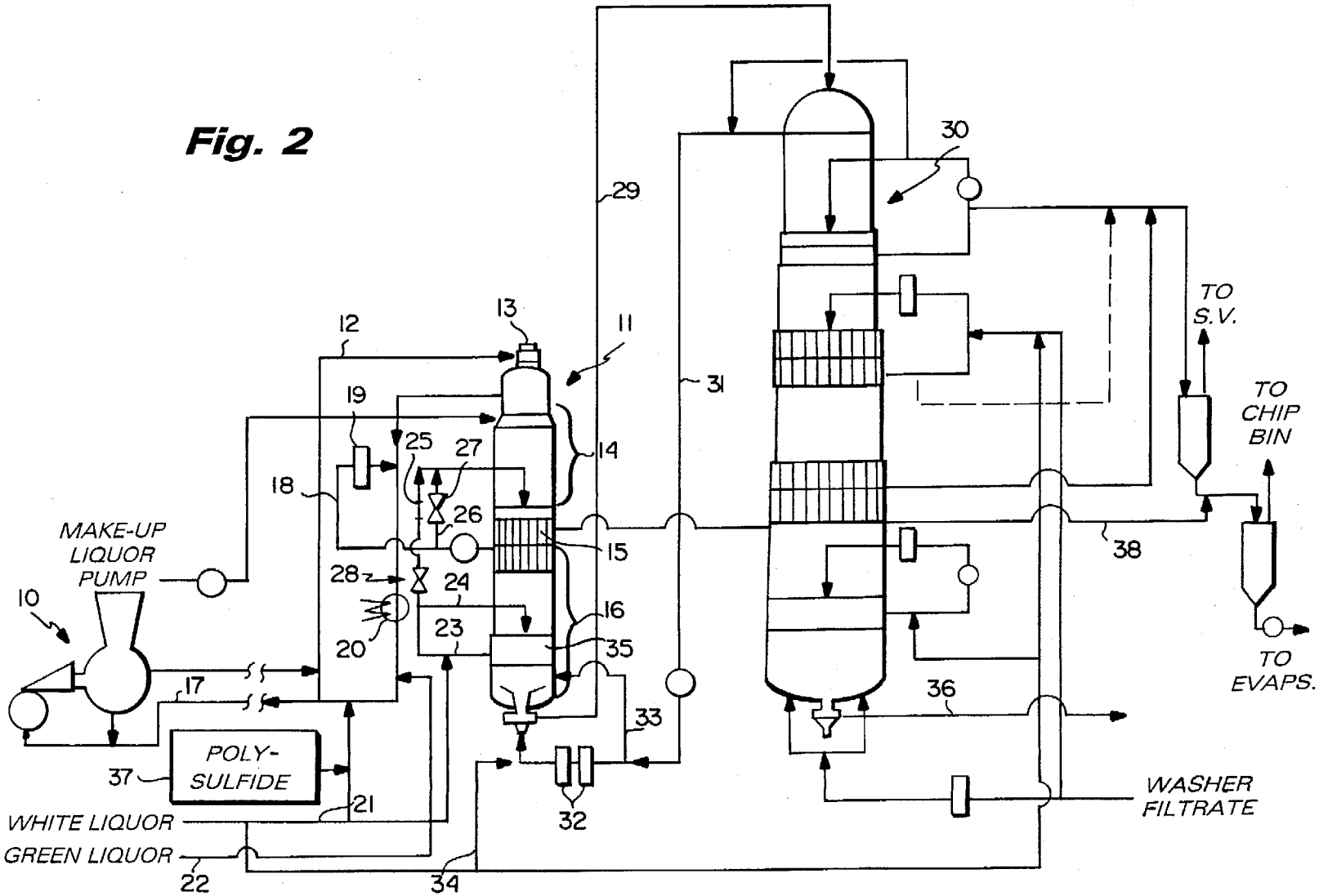
FIG. 2 is a view like that of FIG. 1 only for a system for practicing the method according to the present invention.

FIG. 2 illustrates a system according to the invention. The digester 30 is the same as that in the FIG. 1 embodiment, and of course any other types of conventional digesters may be utilized whether hydraulic or vapor phase, such as MCC® digesters or EMCC® digesters available from Kamyr, Inc. of Glens Falls, N.Y. The high pressure feeder 10 is the same as is the source 21 of white liquor. The impregnation vessel 11 is different, however, having two different zones with first a lower temperature zone and then a higher temperature zone, and preferably with a different level of effective alkali in each of the zones.

The first zone 14 near the top of the impregnation vessel 11 has a relatively low temperature, i.e. the temperature is preferably maintained at about 80°–110° C., preferably 90°–105° C., and more preferably 90°–100° C. The effective alkali concentration in the zone 14 is about 5–30 gr NaOH/l. If sulfur is present it will absorb on the wood. Suitable sources of sulfur that are added to the first zone 14 are white liquor, green liquor, and even black liquor. White liquor addition from source 21 and green liquor addition from source 22 are both illustrated in FIG. 2. In the first zone 14 alkali diffuses into the fiberwall. This opens up the wood structure and dissolves about 5–10% of the wood during pretreatment, which preferably takes about 5–45 minutes, most preferably 10–30 minutes.

In the middle of the impregnation vessel 11 are conventional screens 15, with liquid being withdrawn from one screen 15 into the conduit 18. A cooler 19 may be provided in the conduit 18 to reduce the temperature of the liquor so that the desired relatively cool temperatures are maintained in the zone 14 as discussed above. If necessary another heat exchanger (which preferably effects cooling), shown by reference numeral 20 in FIG. 2, may be provided in the line 17 which returns the wood from the impregnation vessel 11 to the high pressure feeder 10.

Below the first zone 14 in the impregnation vessel 11 is the second zone 16. The temperature in the second zone 16 is higher than in the first zone 14, but below cooking temperature. Also the effective alkali in the second zone 16 is preferably higher than in the first zone 14. For example the temperature in the second zone 16 is about 110°–150° C., more preferably 110°–140° C., and most preferably about 120°–130° C. The time in both of the zones 14, 16 is about the same, that is it is about 5–45 minutes, more preferably 10–30 minutes, in the zone 16. The strength of the effective alkali is preferably at least 5 gr NaOH/l greater than in the first zone 14, typically about 10–80 gr (most preferably about 20–40) NaOH/l. In the zone 16 pretreatment continues to open up the fiberwall and provides an additional amount of dissolved wood, e.g. another 5–10%, making a total amount of dissolved wood of about 10–20%. If sulfur is present it again absorbs on the wood, with suitable sulfur sources being white liquor, green liquor, and black liquor, preferably white liquor. The $HS^-/OH^-$ ratio should be high during the second zone 16, for example enhanced by the addition of polysulfide. Polysulfide addition is shown by reference numeral 37 in FIG. 2. [Polysulfide may alternatively or additionally be added to the first zone 14 too].

Various circulations may be provided in the system illustrated in FIG. 2. For example from the line 18 there may be various branches, for example one branch 25 resulting in recirculation of withdrawn liquor back to the zone 14. A second recirculation line 26, with a remotely controlled valve 27 therein, provided, and another recirculation system 28 may be provided for recirculation into the zone 16, including from the bottom screen 35 therein. For example the upper extraction 18 can alternately recirculate liquor through line 26, and valve 27, back to screen 15. Lower extraction 23 alternately recirculates liquor through valve 28 to line 25, to be recirculated to the screen 15, or liquor can be circulated from screen 35 to line 24, and then back to screen 35.

An optional way of running the impregnation system of FIG. 2 is to add the majority of the white liquor to be used to treat the material to the first impregnation zone 14. Here the temperature is kept low for the reasons discussed above. After zone 14 liquid is extracted through screens 15 and returned through conduit 26 by a circulation system to the level of screens 15. A heat exchanger (not shown) is provided in conduit 26 to heat the recirculated liquid and thus raise the temperature just before it enters the zone 16. In this way the chips are subject to a two stage white liquor pretreatment with the same liquid but at two different temperatures. The preferred temperatures in the two treatments are 80°–110° C. for zone 14, and 110°–150° C. for zone 16.

The screens 15 and 35 can also be used to raise the concentration of cooking chemicals. From screen 15 a flow 38 can be taken to conventional flash tanks, and from the flash tanks to conventional evaporators. The liquid in line 38 contains water and condensates ("wood water") coming into the system with the wood from presteaming. By removing this "wood water" from the system after the first impregnation zone 14 the concentration of chemicals (e.g. white liquor and its constituents) in the second zone 16 is raised. For example if black liquor is used in zone 14, the black liquor and "wood water" are removed through screens 15 and line 38. This way the white liquor added to zone 16 is not diluted by the "wood water".

Screen 35 can also be used to raise the concentration of chemicals. The liquid from zone 16 is withdrawn through screen 35 and recirculated through pipes 24 and/or 25 to the beginning of the zone 16. White liquor is added to this recirculation. The white liquor will be enriched as it displaces out "wood water" and the liquid used in zone 14 through the screens 15. White liquor is also prevented from escaping from zone 16 together with the wood as it is recirculated back through screens 35. In the recirculation system associated with screen 35 the liquid is displaced with a liquid 33 from the cooking zone, or alternatively some black liquid after cooking, or wash filtrate can be used. In this way the wood chips are subject to a high chemical concentration in the zone 16 and will be fully impregnated with cooking liquid. The fully impregnated chips are then cooked in a liquid phase in the cooking zone of digester 30.

In the impregnation vessel 11 one of the zones 14, 16 can be co-current and the other countercurrent, or both can be co-current, or both countercurrent. Utilizing the system of FIG. 2 the final pulp produced in line 36 has measurably (beyond the range of experimental error) enhanced strength compared to the pulp produced utilizing the conventional system of FIG. 1.

While the invention is more easily applied to a separate impregnation vessel 11 as illustrated in FIG. 2, it should be understood that under some circumstances impregnation may be on top of the digester 30. Again the digester 30 may be any suitable type, such as "Lo-Solids"™, EMCC®, or MCC®.

It will thus be seen that according to the present invention an advantageous method for the continuous cooking of cellulosic fibrous material has been provided. While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent methods and processes.

What is claimed is:

1. A method of continuously cooking cellulosic fibrous material, comprising the steps of substantially continuously:

(a) treating cellulosic fibrous material with at least one of white liquor, black liquor, and green liquor in a first zone at a temperature of between about 80°–110° C. and at a first alkali concentration to diffuse alkali into the fiberwalls of the cellulosic fibrous material to open up the cellulose structure and dissolve part of the cellulose;

(b) treating the material from step (a) in a second zone with white liquor and at a temperature at least about 10° C. higher than the first zone and between about 110°–150° C., and at a second alkali concentration higher than the first alkali concentration, to continue to open up the fiberwalls of the cellulosic fibrous material and dissolve part of the cellulose, to effect complete impregnation of the cellulose fiberwalls with alkali; and (c) cooking the cellulosic fibrous material from step (b) at a temperature of about 150°–180° C.

2. A method as recited in claim 1 wherein step (a) is practiced for about 5–45 minutes, and step (b) is practiced for about 5–45 minutes.

3. A method as recited in claim 2 wherein step (a) is practiced at a temperature of about 90°–105° C., and step (b) at a temperature of about 120°–130° C.

4. A method as recited in claim 3 comprising the further step, between steps (a) and (b), of removing at least part of the liquid from the cellulosic fibrous material and replacing the removed liquid with liquid from step (b).

5. A method as recited in claim 4 comprising the further step, between steps (b) and (c), of removing a least part of the liquid from the cellulosic fibrous material and replacing it with liquid from step (c).

6. A method as recited in claim 5 wherein step (a) is practiced with a first alkali concentration of about 5–30 gr NaOH/l, and wherein step (b) is practiced with a second alkali concentration of about 10–80 gr NaOH/l.

7. A method as recited in claim 1 wherein step (a) is practiced at a temperature of about 90°–105° C., and step (b) at a temperature of about 120°–130° C.

8. A method as recited in claim 1 comprising the further steps of, between steps (a) and (b), removing at least part of the liquid from the cellulosic fibrous material and replacing it with liquid from step (b), and between steps (b) and (c), removing a least part of the liquid from the cellulosic fibrous material and replacing it with liquid from step (c).

9. A method as recited in claim 1 wherein step (a) is practiced with a first alkali concentration of about 5–30 gr NaOH/l, and wherein step (b) is practiced with a second alkali concentration of about 10–80 gr NaOH/l.

10. A method as recited in claim 9 wherein step (b) is practiced with a second alkali concentration of about 20–40 gr NaOH/l, and at least about 5 gr/l higher than in the first zone, and wherein step (a) is practiced using at least one of green liquor or white liquor.

11. A method as recited in claim 9 wherein the temperature in steps (a) and (c) are maintained by removing, cooling, and recirculating liquid in the first and second zones.

12. A method as recited in claim 9 wherein step (a) is practiced at a temperature of about 90°–105° C., and step (b) at a temperature of about 120°–130° C.

13. A method as recited in claim 1 wherein the temperature in steps (a) and (c) are maintained by removing, cooling, and recirculating liquid in the first and second zones.

14. A method as recited in claim 13 wherein step (c) is practiced with a second alkali concentration of about 20–40 gr NaHOH/l, and at least 5 gr/l higher than in the first zone.

15. A method as recited in claim 13 wherein step (a) is practiced without polysulfide added to the material in the first zone.

16. A method of continuously cooking cellulosic fibrous material utilizing distinct impregnation zones, comprising the steps of substantially continuously:

(a) treating cellulosic fibrous material with at least one of white liquor, black liquor and green liquor in a first impregnation zone at a temperature of between about 80°–110° C. for about 5–45 minutes to diffuse alkaline from the liquor into the fiberwalls of the cellulosic fibrous material to open up the cellulose structure and dissolve part of the cellulose;

(b) removing liquid from or at the end of the first impregnation zone;

(c) treating the material from step (a) in a second zone with white liquor at a temperature between about 110°–140° C., for about 5–45 minutes to continue to open up the fiberwalls of the cellulosic fibrous material and dissolve part of the cellulose, to effect complete impregnation of the cellulose fiberwalls with alkali; and (d) cooking the cellulosic fibrous material from step (c) at a temperature of about 150°–180° C. wherein step (a) is practiced at a first alkali concentration of about 5–30 gr NaOH/l; and wherein step (c) is practiced at least about 10° C. higher than the first zone and, at a second alkali concentration higher than the first alkali concentration and of about 10–80 gr NaOH/l.

17. A method as recited in claim 16 wherein step (a) is practiced at a temperature of about 90°–105° C. for about 10–30 minutes, and step (b) at a temperature of about 120°–130° C. for about 10–30 minutes.

18. A method as recited in claim 16 wherein the temperatures in steps (a) and (c) are maintained by removing, cooling and recirculating liquid in the first and second impregnation zones.

19. A method as recited in claim 18 wherein step (a) is practiced without polysulfide added to the material in the first zone.

20. A method as recited in claim 16 wherein step (a) is practiced using at least one of green liquor or white liquor.

21. A method as recited in claim 16 comprising the further step (e) of removing liquid between steps (c) and (d).

22. A method as recited in claim 21 comprising the additional step of removing liquid from one of steps (b) and (e) from the entire impregnation/cooking system.

23. A method as recited in claim 21 comprising the further step of recirculating liquid from one of steps (b) and (e) to one of steps (a) and (c).

24. A method as recited in claim 16 wherein the temperature in steps (a) and (c) are maintained by removing, cooling, and recirculating liquid in the first and second impregnation zones.

* * * * *